US006401978B1

(12) United States Patent
Young

(10) Patent No.: US 6,401,978 B1
(45) Date of Patent: Jun. 11, 2002

(54) TOOTHPASTE DISPENSER

(75) Inventor: Christopher S. Young, South Kent, CT (US)

(73) Assignee: Innovative Injectors, Inc., Litchfield, CT (US)

( * ) Notice: Subject to any disclaimer, the term of this patent is extended or adjusted under 35 U.S.C. 154(b) by 0 days.

(21) Appl. No.: 09/598,186

(22) Filed: Jun. 21, 2000

(51) Int. Cl.[7] ..... B65D 35/28
(52) U.S. Cl. ..... 222/101; 222/333
(58) Field of Search ..... 222/101, 103, 222/333

(56) References Cited

U.S. PATENT DOCUMENTS 1,617,917 A * 2/1927 Lawton ..... 222/103
2,491,161 A * 12/1949 Campbell
2,596,310 A * 5/1952 Vita ..... 222/103
2,795,356 A * 6/1957 Tschumy ..... 222/103
3,198,389 A * 8/1965 Dunning ..... 222/103
3,325,057 A * 6/1967 Watson, Jr. ..... 222/103
3,738,533 A * 6/1973 Bertrand ..... 222/103
4,234,104 A * 11/1980 Apuzzo, Jr. et al. ..... 222/101
4,258,864 A * 3/1981 Karamanolis et al. ..... 222/101
5,199,610 A * 4/1993 Gagliardi ..... 222/101
5,845,813 A 12/1998 Werner
5,975,362 A 11/1999 West

* cited by examiner

*Primary Examiner*—Joseph A. Kaufman
*Assistant Examiner*—Stephanie Willatt
(74) *Attorney, Agent, or Firm*—Carmody & Torrance LLP

(57) ABSTRACT

An apparatus for dispensing a substance from a collapsible tube. The apparatus comprises: a housing with a slider positioned therein, first and second flexible members passable through a passage in the slider, a rod for supporting the slider within the housing, and a motor coupled to the rod for causing rotation of the rod. When the rod rotates, the slider moves along the rod and urges the first flexible member toward the second flexible member. This movement causes the substance in the tube to be dispensed.

11 Claims, 2 Drawing Sheets

TOOTHPASTE DISPENSER

BACKGROUND OF THE INVENTION

The present invention relates generally to dispensers, and in particular, to an improved toothpaste dispenser that more effectively dispenses toothpaste from collapsible toothpaste containing tube disposed therein.

A wide variety of both manually operable and powered devices for dispensing toothpaste and other substances from a collapsible tube are well known in the art. For example, U.S. Pat. No. 5,845,813, to Werner, describes a motorized toothpaste dispenser that utilizes a sliding horizontal cylindrical wedge that presses a toothpaste tube against a fixed vertical planer wedge. The cylindrical wedge is moved by a line and pulley system driven by a motor and spur gearing. In another toothpaste dispenser described in U.S. Pat. No. 5,975,362 to West, a pinch roller assembly receives the toothpaste tube in a partially collapsed condition, and moves along the toothpaste tube and collapses a further portion thereof so as to pressurize the toothpaste therein and dispense the toothpaste out through the nozzle end.

Unfortunately, the prior art toothpaste dispensers are seen to be less than desirable, as they are either too complex or too expensive to manufacturer on a widespread basis.

Accordingly, it is desirable to provide an improved toothpaste dispenser that more efficiently and easily dispenses toothpaste from a collapsible tube disposed therein. The present invention also overcomes the perceived deficiencies in the prior art toothpaste dispensers and further achieves the aforementioned and below mentioned objectives.

SUMMARY OF THE INVENTION

Generally speaking, in accordance with the present invention, an apparatus for dispensing a substance from a collapsible substance containing tube is provided. The tube most preferably will have an outlet opening through which the substance is dispensed. In the preferred embodiment, the apparatus will include a housing, a slider positioned within the housing, the slider itself having a passage therethrough, and first and second spaced apart flexible members being disposed in the housing and passable through the passage in the slider. The first and second flexible members exert pressure on the tube. The apparatus also includes a rod for supporting the slider within the housing, wherein the slider is movable in the housing and along the rod upon the rotation of the rod. A motor couplable to the rod with sprockets causes rotation of the rod. In this way, the movement of the slider along the rod urges the flexible members towards each other such that pressure is exerted against the tube thereby collapsing the tube and pressurizing the substance therein so as to cause the dispensing of the substance out the outlet opening in the tube.

The present invention also provides for a nozzle having a passage in registration with the outlet opening in the tube and cover provided. Also, the cover may be provided in a "snap-fit" arrangement that provides convenience and facilitates replacing the tube, improved aesthetics when the apparatus is not in use, and improved safety assurances. In the preferred embodiment, the rod is threaded and the slider includes an aperture having complimentary threads for receiving the rotatable rod, such that the rotation of the rod causes the slider to move along the rod. The slider may also include a rib for guiding the slider and along and within the housing. Still further, the passage in the slider is tapered so as to urge the first flexible member towards the second flexible member.

Another advantageous feature of the present invention is a slotted opening strip provided along a surface of the housing and wherein the slider includes an indicator thereon, such that the indicator is viewable through the slotted opening so that a user can view the relative amount of substance left in the tube.

In a preferred embodiment of the present invention, the apparatus is a toothpaste dispenser and the substance contained within the tube is toothpaste.

Accordingly, it is an objective of the present invention to provide an improved toothpaste dispenser with an improved toothpaste dispensing construction.

Another objective of the present invention is to provide an improved toothpaste dispenser that more effectively dispenses toothpaste therefrom.

Yet another objective of the present invention is to provide an improved toothpaste dispenser that can be more economically manufactured.

Still another objective of the present invention is to provide an improved apparatus for dispensing a substance from a collapsible substance containing tube, wherein the substance may be any number of viscous substances, such as preparations for the hands, body, hair, baby or dentures, toothpaste, glue, caulking or icing for cake decorations.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying figures, in which.

DETAILED DESCRIPTION OF THE PREFERRED EMBODIMENTS

Figure 2:
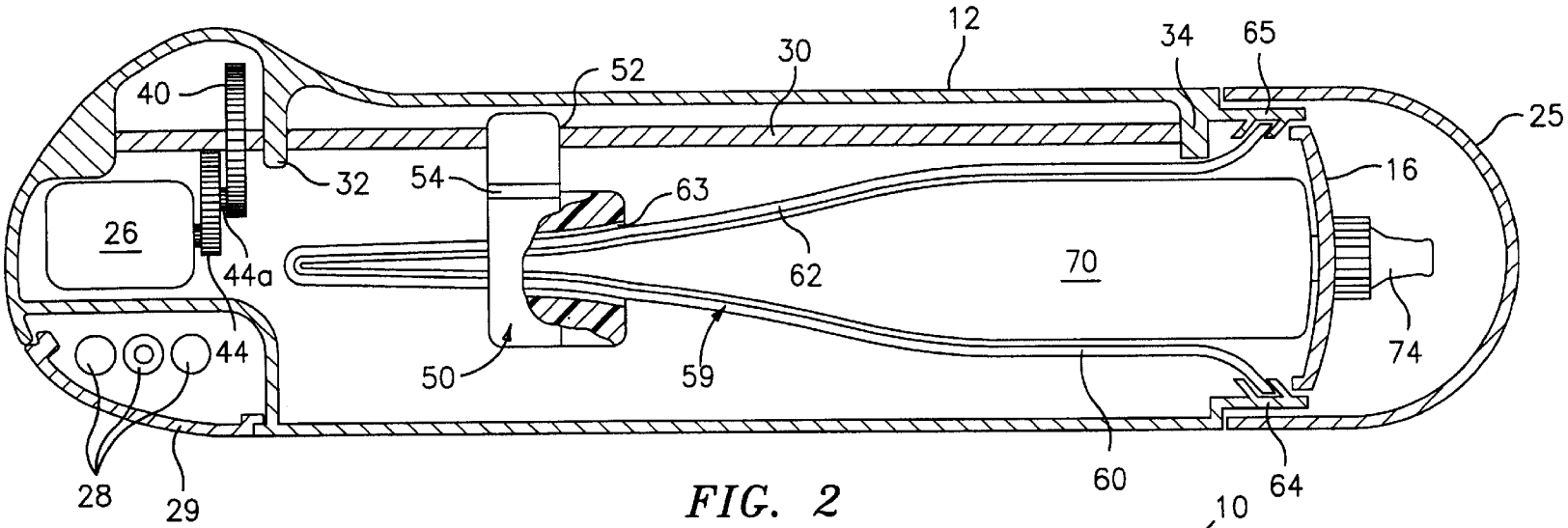
FIG. 2 is an internal cross sectional view of the apparatus of FIG. 1 taken about lines 2—2 of FIG. 1.
Figure 1:
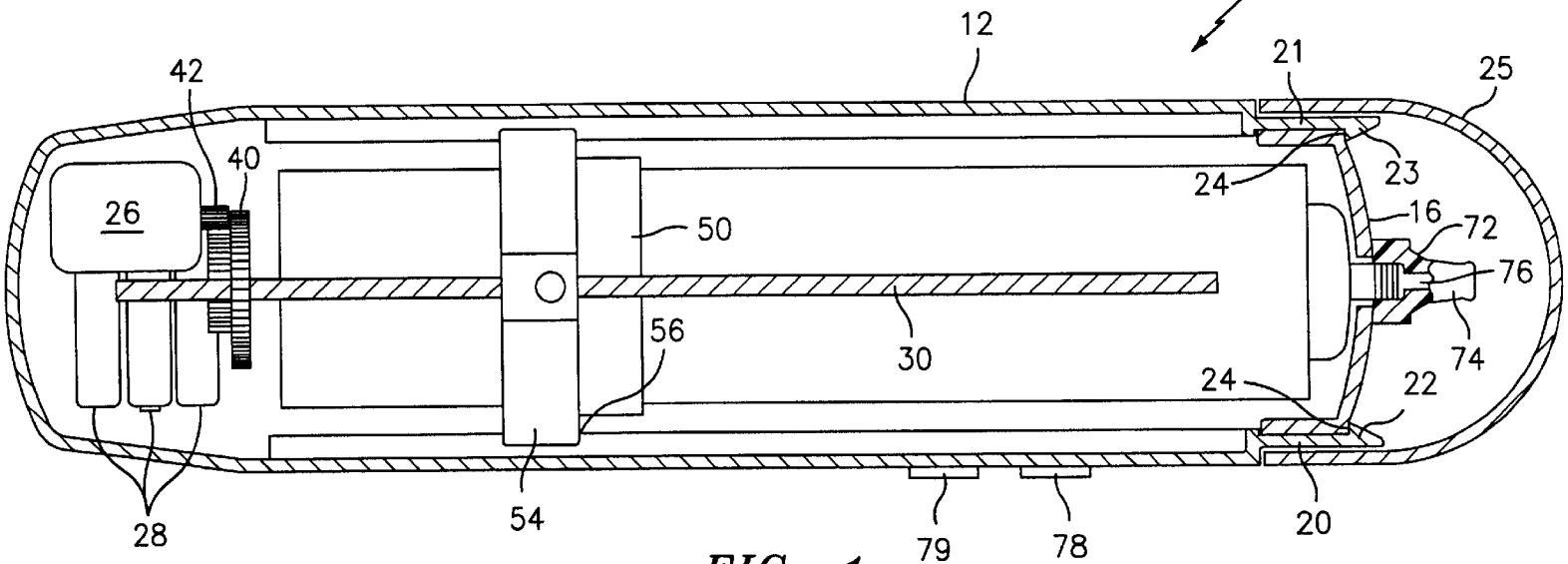
FIG. 1 is a top plan internal view illustrating the apparatus in accordance with the present invention.
Figure 3:
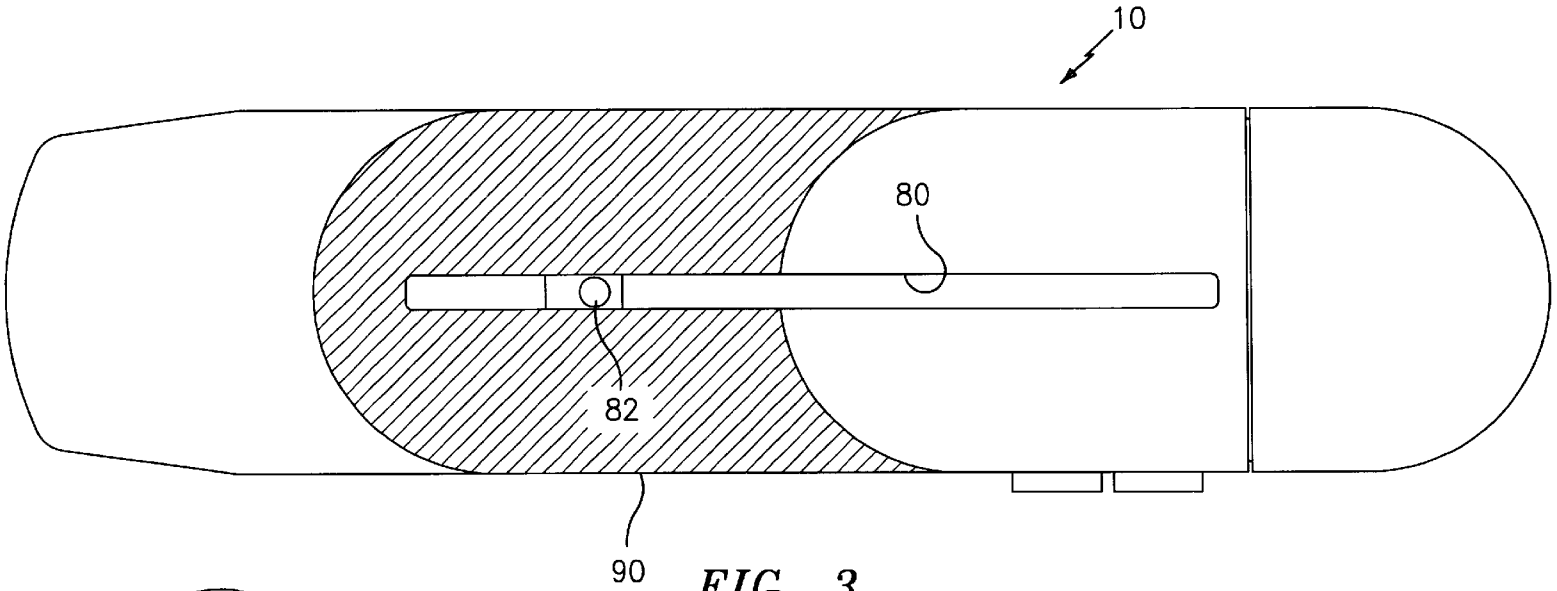
FIGS. 3 and 4 are side elevational external views of the present invention illustrating additional features thereof.
Figure 4:
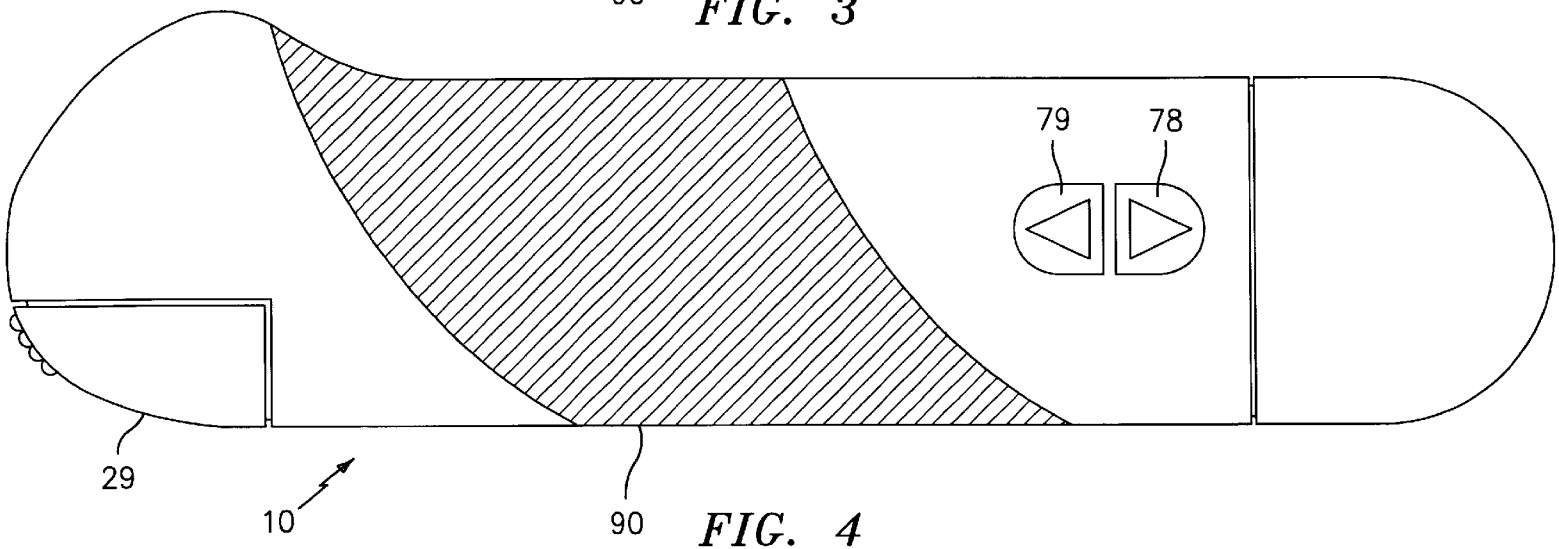

Reference is first made to FIGS. 1 and 2, wherein an apparatus, generally indicated at 10, for dispensing a substance from a collapsible substance containing tube, is constructed in accordance with the preferred embodiment of the present invention. It should be understood that the present invention is utilizable for dispensing a wide variety of substances contained within a collapsible tube. For example the substance may be preparations for hands, body, hair, a baby or dentures, or may be caulking, glue, toothpaste or icing/frosting for cake/cookie decorations, or any other viscous substance that is packaged in a collapsible tube. For convenience and illustrative purposes only, reference hereafter will be made to toothpaste as the substance contained in the tube, although it should be understood that the only requirement for dispensing substances other than toothpaste or those mentioned above is the need to construct the collapsible substance containing tube (described below) to be compatible with the construction of apparatus 10, or constructing an apparatus in accordance with the present invention, sized to be compatible with the tube.

In the preferred embodiment, apparatus 10 includes a housing generally indicated at 12, and a cover 16. Cover 16 may be securable to housing 12 in a variety of ways. In the preferred embodiment, housing 12 has a "snap-fit" arrangement for releaseably opening cover 16 relative to housing 12. This is achieved by providing interlocking arms 20 and 21 integrally molded to housing 12, with each arm 20 and 21 having a respectively extending finger 22, 23 that interlocks in a "snap-fit" arrangement with a lip 24 on cover 16 so as to releasably secure cover 16 to housing 12. This "snap-fit" arrangement is preferable in that it permits cover 16 to break away and/or open in the event that excessive pressure builds within a tube disposed within housing 12. This arrangement also easily facilitates replacing the tube therein, wherein it is only necessary to pry, in a known manner, arms 20 and 21 in a direction opposite to each other to cause the disengagement between fingers 22 and 23 and lip 24. Lastly, a cap 25 may be provided when apparatus 10 is not in use. Cap 25 may be "friction-fitted" or "snapped-on" as would be well understood in the art, such as in a manner similar to a deodorant or shaving cream can and cap combination.

Disposed within a compartment (not shown) of housing 12 is a motor 26, preferably secured to housing 12 or in the compartment by rivets, screws or other securing means as would be well appreciated by one of ordinary skill in the art. The motor, preferably a DC motor, may be manufactured by Mabuchi. Being that apparatus 10 is preferably portable, one or more batteries 28 are used, such as AA or AAA batteries, although it should be well understood that the present invention is easily modifiable so as to utilize rechargeable batteries and/or have an adapter where the present invention can be powered by an A/C power source. Motor 26 causes the advancing and retracting of a slider, as will be described below. A battery cover 29 may be provided to access the batteries in the housing, all in a known matter.

A threaded rod 30, preferably made of metal, is itself supported by a rear rod support 32 and a front rod support 34. Rear rod support 32 and front rod support 34 may be constructed in a plurality of ways. Specifically, they each may extend down into housing 12 and have an aperture therethrough. The diameter of the apertures may be less than the diameter of rod 30 at the sections through which supports 32 and 34 do not support rod 30. However the diameter of rod 30 at the section supported by supports 32, 34 would be less than the diameter of rod at the other sections thereof. In this way, the rod will not slide through supports 32 and 34. Alternatively, rod 30 may be horizontally secured in sockets (not shown) mounted along or depending from the sidewalls of the interior of housing 12. Still further, sleeves may be used to keep rod 30 in place so there is no need to make the rod 30 of differing diameters. This use of sleeves would also be known to be skilled in the art. Either way, however, the important aspect is that rod 30 is permitted to freely rotate by virtue of its engagement with motor 26.

To this end, a sprocket 40 is attached to rod 30. Motor 26 also includes a sprocket 42 directly coupled to a shaft (not shown) thereof. An intermediate sprocket 44 (mountable to a shaft (not shown) in the housing) interlocks, or meshes with sprocket 42. Sprocket 44 may also have a rotatably coupled sprocket 44*a* to mesh with sprocket 40 attached to rod 30. Sprocket 44*a* may or may not be the same diameter as sprocket 42. In this way, the rotation of sprocket 42 by motor 26 permits rod 30 to rotate. It should be understood that a further plurality of sprockets, or the same number as set forth above with differing diameters, may be provided so as to permit the desired step up/down rotation speed of rod 30. The number of batteries 28 may also factor into the rotational speed of rod 30. Batteries 28 are electrically connected to motor 26 in a known manner by wires and/or electrical contact pads.

A slider 50 is provided and moveable along rod 30 by virtue of a complementary threaded aperture 52 therethrough which permits slider 50 to move along rod 30 when rod 30 rotates. Slider 50 preferably includes a rib 54 on opposing sides of slider 50, which may be received in a complimentary groove 56 in the inner sidewalls of housing 12. This construction both prevents slider 50 from binding as it advances through and within housing 12 and also provides additional support for slider 50 and the weight of a tube disposed therein.

A tube holder, generally indicated of 59, preferably of a unitary one-piece construction, includes two members, a first flexible member 60 and a second flexible member 62. Tube holder 59 is also disposed within housing 12. Member 60 is spaced apart from member 62 and disposed through a tapered passage 63 in slider 50. In the preferred embodiment, flexible members 60 and 62 are rectangular in shape so as to most effectively pressurize the tube as discussed below, however, other dimensional shapes are also within the scope of the present invention. Each end of each respective member 60, 62 may be received in a corresponding slot 64, 65 formed on the inner sidewalls of housing 12. The other end of holder 59, where members 60, 62 are integrally joined, may be left to "float" as this back end is well supported by slider 50. The inner protrusions, such as depending rear rod support 32, prevents slider 50 from disengaging from holder 59. Flexible members 60 and 62 are sufficiently spaced apart so as to receive a tube 70 therebetween. As stated above, for convenience, tube 70 will be described as a collapsible toothpaste tube.

At the front end of tube 70 is a threaded tip 72 through which the toothpaste within tube 70 is dispensed and on which a removable cap (not shown) can be secured. A nozzle 74 which may be of different lengths is provided with a passage 76 that is in registration with the opening in threaded tip 72 of tube 70. Nozzle 74 preferably has a complimentary threaded inner surface to threadably receive tip 72. An "O-ring" or other suitable seal member may be incorporated within nozzle 74 to further prevent the toothpaste from backing up within nozzle 74 and "oozing" out between the top surface of tube 70 and the edge of nozzle 74. When nozzle 74 is secured to tip 72 of tube 70, tube 70 is adequately supported within housing 12 at the front by nozzle 74 and cover 16, while the body of tube 70 is supported by flexible members 60, 62 and slider 50.

Motor 26 is preferably operated by a forward button 78 or a reverse button 79 which are electrically connected to motor 26 by wires or electrical contacts (not shown) as would be well understood by one of ordinary skill in the art. Alternatively, a toggle or momentary flip switch may be provided on the outer surface of housing 12 for a forward movement of slider 50, an intermediate off position and a reverse movement of slider 50. Still further, a slide switch may be provided instead.

The operation of the present invention should now be well appreciated. Specifically, a forward operation of the motor 26 will cause sprocket 42 to rotate thus causing sprocket 44 to rotate thus ultimately causing the rotation of sprocket 40, fastened to rod 30, thereby causing rod 30 to rotate. In turn, slider 50 will slidably move along the length of rod 30 towards nozzle 74. As it does so, the flexible members 60, 62 will be compressed by their slidability through tapered passage 63 of slider 50, thereby causing pressure against tube 70 thus causing the collapsing of tube 70 and pressurizing the toothpaste therein so as to cause the dispensing of the toothpaste through tip 72 and out nozzle 74.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

Additionally, housing 12 may also contain a slotted opening 80 along a surface thereof and preferably above slider 50. In this way, slider 50 may be provided with an indicator, such as a fluorescent or otherwise bright "dot" 82 which may be viewed through the slotted opening 80 in the top surface of housing 12. This will permit a user to view the relative amount of toothpaste left in tube 70. This will facilitate recognition as to when replacement of the tube is necessary.

Moreover, tube holder 59 is preferably about 0.040" thick. This provides the necessary flexibility and strength to support, nest, and compress tube 70 as appropriate. Also the molding of tube holder 59 is easily achieved. The plastic compositions of housing 12, and slider 50 can be made from polyethylene, polypropylene, polyacrylate and/or polyvinyl and the like. Alternatively, the sprockets and rod can be made of metal for greater durability. The motor and circuit wires or contacts are substantially made of metal and/or plastic as would be commercially available and understood.

Lastly, as stated above, the present invention, while being described with respect to toothpaste, should be understood that it can be applied to the dispensing of a wide variety of substances, such as hand, body, hair, baby or denture products, or caulking, glue or icing/frosting products that are packaged in a collapsible tube. Also, the outer surface of housing 12 may have soft molded portions 90 to provide for easy gripping.

It is also to be understood that the following claims are intended to cover all of the generic and specific features of the invention described herein and all statements of the scope of the invention that as a matter of language might fall therebetween.

What I claim is:

1. An apparatus for dispensing a substance from a collapsible substance containing tube, the tube having an outlet opening through which the substance is dispensed, the apparatus comprising:

a housing;

a slider positioned within the housing, the slider having a passage therethrough;

a tube holder, comprising a first flexible member and a second flexible member spaced apart from the first flexible member, the first and second flexible members being disposed in the housing and passable through the passage in the slider, the first and second flexible members for exerting pressure on the tube;

first and second slots formed in the housing, wherein the respective end of each flexible member is positionable in the respective slot;

a rod for supporting the slider within the housing, the slider being movable along a length of the housing along the rod upon the rotation of the rod;

a motor couplable to the rod for causing rotation of the rod;

wherein the movement of the slider along the rod urges the first flexible member towards the second flexible member;

whereby the urging of the first and second flexible members towards each other causes pressure to be exerted against the tube thereby collapsing the tube and pressurizing the substance therein so as to cause the dispensing of the substance out the outlet opening in the tube.

2. The apparatus as claimed in claim 1, including a nozzle having a passage in registration with the outlet opening in the tube, the nozzle being adapted for coupling to and supporting one end of the tube.

3. The apparatus as claimed in claim 1, including a cover securable to the housing, wherein the housing includes first and second interlocking arms and the cover includes a lip thereon;

wherein the cover is releasably secured to the housing by the interlocking of the first and second interlocking arms with the lip.

4. The apparatus as claimed in claim 1, wherein the rod is threaded and the slider includes an aperture having complimentary threads for being received by the rod, such that the rotation of the rod causes the slider to move along the rod.

5. The apparatus as claimed in claim 1, wherein the slider includes at least one rib for guiding the slider within the housing.

6. The apparatus as claimed in claim 1, wherein the passage in the slider is tapered so as to urge the first flexible member towards the second flexible member.

7. The apparatus as claimed in claim 2, wherein the nozzle includes an "O-ring" disposed therein to improve the seal between the outlet opening in the tube and the nozzle.

8. An apparatus for dispensing a substance from a collapsible substance containing tube, the tube having an outlet opening through which the substance is dispensed, the apparatus comprising:

a housing;

a slider positioned within the housing, the slider having a passage therethrough;

a tube holder, comprising a first flexible member and a second flexible member spaced apart from the first flexible member, the first and second flexible members being disposed in the housing and passable through the passage in the slider, the first and second flexible members for exerting pressure on the tube;

a rod for supporting the slider within the housing, the slider being movable along a length of the housing along the rod upon the rotation of the rod;

a motor couplable to the rod for causing rotation of the rod;

wherein the movement of the slider along the rod urges the first flexible member towards the second flexible member; and a slotted opening along a surface of the housing and the slider includes an indicator within the housing such that the indicator is viewable through the slotted opening;

whereby a user can view the relative amount of substance left in the tube.

9. A toothpaste dispenser for dispensing toothpaste from a collapsible toothpaste containing tube, the tube having an outlet opening through which the toothpaste is dispensed, the apparatus comprising:

a housing;

a slider positioned within the housing, the slider having a passage therethrough;

a first flexible member and a second flexible member spaced apart from the first flexible member, the first and second flexible members being disposed in the housing, wherein a portion of the flexible members are passable through the passage in the slider, the first and second flexible members for exerting pressure on the tube;

first and second slots formed in the housing, wherein the respective end of each flexible member is positionable in the respective slot;

a rod for supporting the slider within the housing, the slider being movable along a length of the housing along the rod upon the rotation of the rod;

a motor couplable to the rod for causing rotation of the rod;

wherein the movement of the slider along the rod urges the first flexible member towards the second flexible member;

whereby the urging of the first and second flexible members towards each other causes pressure to be exerted against the tube thereby collapsing the tube and pressurizing the toothpaste therein so as to cause the dispensing of the substance out the outlet opening in the tube.

10. The toothpaste dispenser as claimed in claim 9, wherein the rod has a first sprocket attached thereto and the motor include a motor sprocket attached thereto, and wherein the first sprocket is coupled to the motor sprocket such that the rotation of the motor sprocket causes the rotation of the first sprocket;

whereby the rotation of the first sprocket causes the rod to correspondingly rotate.

11. The toothpaste dispenser as claimed in claim 10, including an intermediate sprocket that meshingly engages the first sprocket and the motor sprocket such that the motor sprocket rotates the intermediate sprocket and the intermediate sprocket rotates the first sprocket.

* * * * *